United States Patent [19]

Lemons et al.

[11] Patent Number: 4,864,476

[45] Date of Patent: Sep. 5, 1989

[54] OUTDOOR LIGHTING SYSTEM

[75] Inventors: Thomas M. Lemons, Marblehead, Mass.; Kenneth M. Spink, Jerome, Mich.

[73] Assignee: Qualite Sports Lighting, Inc., Hillsdale, Mich.

[21] Appl. No.: 210,380

[22] Filed: Jun. 23, 1988

[51] Int. Cl.[4] ..... F21V 7/04

[52] U.S. Cl. ..... 362/348; 362/297; 362/349

[58] Field of Search ..... 362/297, 346, 347, 348, 362/349

[56] References Cited

U.S. PATENT DOCUMENTS

| | | | |
|---|---|---|---|
| D. 254,694 | 4/1980 | Drost et al. | D26/63 |
| D. 257,891 | 1/1981 | Drost et al. | D26/69 |
| 1,199,071 | 9/1916 | Heckert | 362/348 |
| 1,550,645 | 8/1925 | Godley | 362/348 |
| 1,555,410 | 9/1925 | Godley | 362/348 |
| 1,566,906 | 12/1925 | Matisse et al. | 362/348 |
| 1,570,503 | 1/1926 | Kzalicek | 362/348 |
| 1,590,130 | 6/1926 | Sturgeon, Jr. | 362/348 |
| 1,621,752 | 3/1927 | Raynolds | 362/348 |
| 1,639,363 | 8/1927 | Balsillie | 362/348 |
| 1,915,842 | 5/1933 | Winkler | 362/348 |
| 3,401,258 | 9/1968 | Guth | 362/348 |
| 3,428,800 | 2/1968 | Levin et al. | 362/348 |
| 3,511,983 | 5/1970 | Dorman | 362/297 |
| 4,190,881 | 2/1980 | Drost et al. | 362/250 |
| 4,374,407 | 2/1983 | Drost et al. | 362/432 |
| 4,404,620 | 9/1983 | Takahashi et al. | 362/297 |
| 4,417,300 | 11/1983 | Bodmer | 362/348 |

*Primary Examiner*—Stephen F. Husar
*Assistant Examiner*—Richard R. Cole
*Attorney, Agent, or Firm*—Beaman & Beaman

[57] ABSTRACT

An outdoor lighting system utilizing reflectors capable of producing a uniform distribution of light over a large area. The system reflectors employ parabolic reflecting surfaces utilizing a plurality of adjacent small concave and convex configurations for distributing the light in a uniform manner with a minimum of spillage, and a single reflector may employ three separate types of reflecting configurations to achieve the desired result at variable distances from the light source.

11 Claims, 3 Drawing Sheets

OUTDOOR LIGHTING SYSTEM

BACKGROUND OF THE INVENTION

When lighting large areas, such as athletic fields, baseball diamonds, football fields and the like, it is important that the light intensity be closely controlled. Experience has indicated that different sports require a different degree of illumination, and in some instances, baseball for instance, the degree of illumination required in the outfield may be different than that necessary to light the infield.

When illuminating sports fields it is important that the light intensity be substantially uniform over the primary playing area wherein "light" or "dark" localized conditions be avoided. Significant localized differences in the degree of illumination of an athletic field make it very difficult to observe and accurately locate and track a moving object, i.e. a ball in flight, and control and uniformity of illumination is very important.

As the intensity of illumination is related to the distance of the portion of the field being illuminated from the luminaire the distance of the luminaire from the field portion being lighted is a significant factor, but as the operating costs of illuminating an athletic field is significant it is important that the lighting system be as economical to operate as possible, and of course, the cost of original installation of the system is of significance.

Areas being illuminated are often located in residential or relatively high population density areas, and the lighting of an athletic field is often objected to by nearby residents due to the light pollution occurring resulting from light "spillage."

It is known to endeavor to uniformly illuminate athletic fields by the use of luminaire reflectors, shields, lenses, screens and the like wherein attempts are made to focus the light in a desired direction. Prior art systems have not successfully provided efficient uniform illumination over relatively large areas with a minimum of light spillage, and often, where a high degree of illumination is required, the lighting systems are "overdesigned" producing "hot spots" and sacrificing efficiency of operation. Further, many lighting systems for athletic fields are not capable of adequately confining the projected light resulting in the creation of light pollution and ill feelings by neighbors due to light spillage.

It is an object of the invention to provide an outdoor lighting system utilizing parabolic reflectors wherein highly efficient uniform lighting of an area may be achieved with a minimum of apparatus, i.e. lighting fixtures, and wherein the apparatus may be relatively economically produced.

Another object of the invention is to provide an outdoor lighting system employing parabolic reflectors wherein the reflecting surface includes a plurality of small light directing surfaces of an elliptical configuration to direct and evenly distribute reflected light.

A further object of the invention is to provide an outdoor lighting system utilizing a parabolic reflector having a plurality of reflecting surfaces defined thereon for substantially evenly distributing the reflected light over an area even though the light is obliquely directed upon the area.

Yet another object of the invention is to provide an outdoor lighting system utilizing a parabolic reflector wherein light reflected in an oblique direction over the area to be lighted is substantially evenly distributed over such area without the use of lenses and shields.

In the practice of the invention the lighting system utilizes a substantially parabolic reflector in conjunction with a high intensity lamp, such as of the metal halide type, the lamp light source being located at the focal point of the reflector. Usually, the reflector is formed of metal having a highly light reflective inner parabolic surface. In planes perpendicular to the reflector axis the reflector is circular in configuration and includes upper, lateral and lower regions.

A basic concept of the invention involves the use of oval or elliptical peen configurations to modify a circular beam of light into an oval beam. Such a modified light beam is particularly suitable for distributing light over areas located at an intermediate distance from the light source, i.e. the central regions of a football field lighted by luminaires located at the sides of the field. The peening produces a plurality of adjacent elliptical depressions and ridges which are relatively parallel having their major length substantially vertically oriented and the light being reflected due to the peening of the reflective surface is transmitted in an oval beam having its major dimension identically oriented to the major dimension of the peened configurations.

In one embodiment of the invention the peenings may extend throughout the entire area of the light reflecting surface, but in other embodiments of the invention the peening may only occur over a portion of the reflector surface and other configurations in the reflecting surface are utilized to shape the light beam in the most efficient manner.

In such other modifications a portion of the reflecting surface, such as the lower region, may be peened with a plurality of oval peen marks having a primary dimension substantially vertically oriented while the lateral and upper regions of the reflector may be provided with a plurality of concentric radial flutes or steps. At the reflector lateral regions the flutes may contain elliptical reflecting depressions wherein the dimension of the major axis of the depression is only slightly greater than the minor axis dimensions, and at the flutes located at the reflector upper region, the flutes may be smooth surfaced to minimize light diffusion and produce maximum light reflection for lighting the areas the greatest distance from the reflector. Such a reflector having three types of light directing and controlling surfaces is capable of evenly distributing the light over areas at different distances from the reflector.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

An outdoor lighting system utilizing the apparatus of the invention normally includes a plurality of luminaires mounted upon poles installed adjacent the area to be illuminated. Outdoor lighting systems in accord with the invention are particularly suitable for use with athletic playing fields, such as for football, soccer, baseball, tennis courts and the like. Of course, lighting systems in accord with the invention may also be used to light parking lots and similar areas, but the invention is particularly suitable wherein uniform lighting over a specified area with a minimum of light spillage and light pollution is required.

Figure 1:
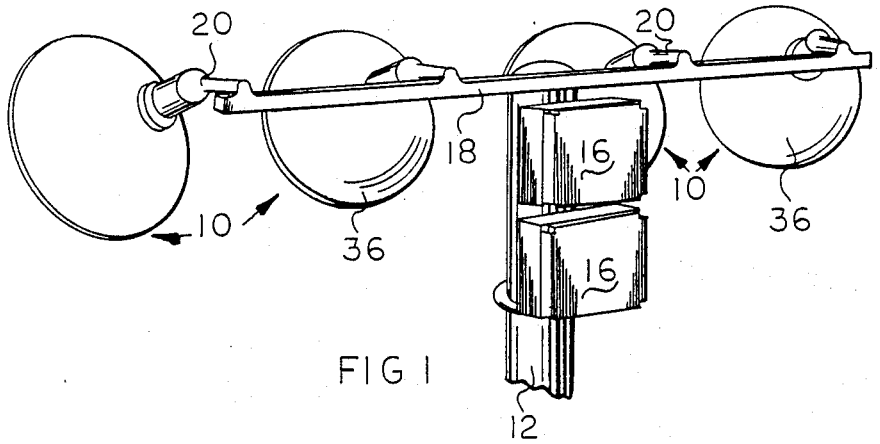
FIG. 1 is a rear perspective view of a lighting system upon which four luminaires in accord with the invention are mounted.
Figure 2:
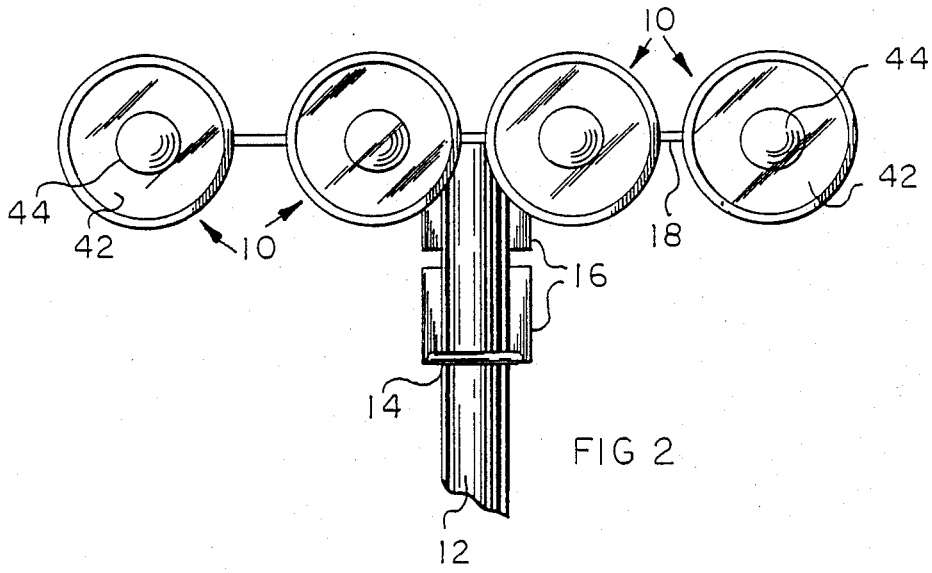
FIG. 2 is a front, elevational view of the apparatus of FIG. 1.

In FIGS. 1 and 2 a typical pole-mounted installation is illustrated wherein four luminaires 10 are mounted upon the top of a pole 12. The luminaire support structure includes a mounting frame 14 to which ballast-containing boxes 16 are affixed, and the frame includes a horizontally-disposed support bar 18 upon which four luminaires 10 are adjustably mounted. Of course, more than four luminaires may be mounted upon a common pole 12 and it is usual for batteries of luminaires, such as eight or sixteen to be mounted upon a common pole support.

Figure 3:
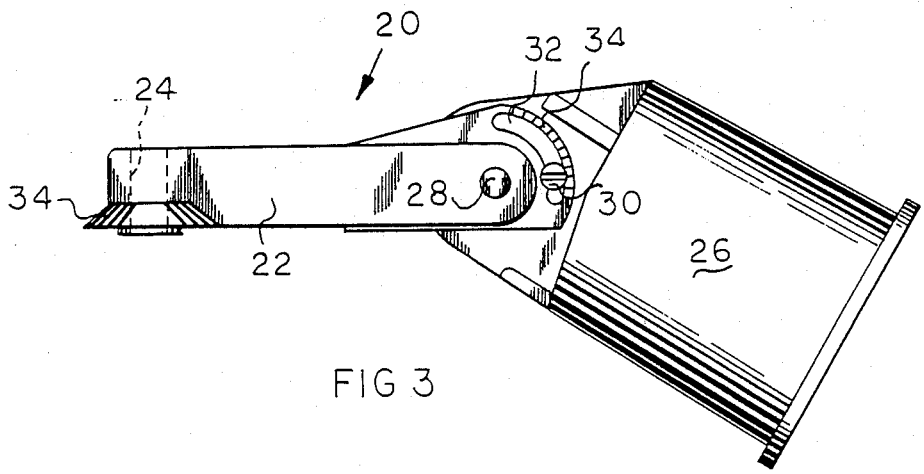
FIG. 3 is an elevational side view of the reflector mounting bracket as used with the invention.

Each luminaire includes a mounting bracket 20 best shown in FIG. 3. The bracket includes a base 22 which is mounted to the support bar 18 by a vertically oriented bolt, not shown, extending through hole 24 whereby the bracket base may be pivoted in a horizontal plane and affixed at the desired angle.

At its outer end the bracket 20 includes a socket 26 pivotally attached to the base 22 by a horizontally-disposed pivot pin 28 wherein the socket can be pivoted in a vertical plane. A lock screw 30 extends through the arcuate slot 32 formed in the bracket base concentric to pin 28 and during adjustment the locking screw 30 is loosened to permit the desired vertical orientation of the socket to be achieved which is then locked by tightening the screw.

Indicia marks 34 are defined on the bracket base 22 adjacent the hole 24 and adjacent the slot 32 wherein the angular relationships of the bracket components to the support bar 18 and to each other may be accurately determined. In this manner the position of the luminaires 10 on the support bar and their relationship to the pole 12 can be predetermined and the lighting system "aim" can be adjusted before the unit is erected.

The shell or reflector 36 is mounted upon the socket 26 having an axis coincident with the axis of the socket, and the reflector is formed of metal having a substantially parabolic configuration at 38 while the configuration of the reflector with respect to radial planes transverse to the reflector axis is circular. The reflector base 37 is cylindrical and is received within socket 26.

The reflector includes an outer edge or lip 40, usually of about a 24 inch diameter, and usually, a front cover glass 42, FIG. 2, is mounted upon the reflector by retaining clips, not shown, to prevent foreign matter from entering the reflector and reducing the efficiency of the reflecting surface.

A light source such as a metal halide lamp 44 is received within the socket 26 in electrical contact with conventional lamp socket terminals, not shown, and the filament or light source within the lamp is located at the focal point of the reflector 36 in order to most effectively utilize the characteristics of the parabolic reflecting surface. Preferably the lamp used is of the type having a built-in glare guard which will direct all of the emitted light toward the reflector. An acceptable lamp is manufactured by Venture Lighting Co. of Cleveland, Ohio, Model MS-1500/HBU GG, Product No. 72855.

Figure 5:
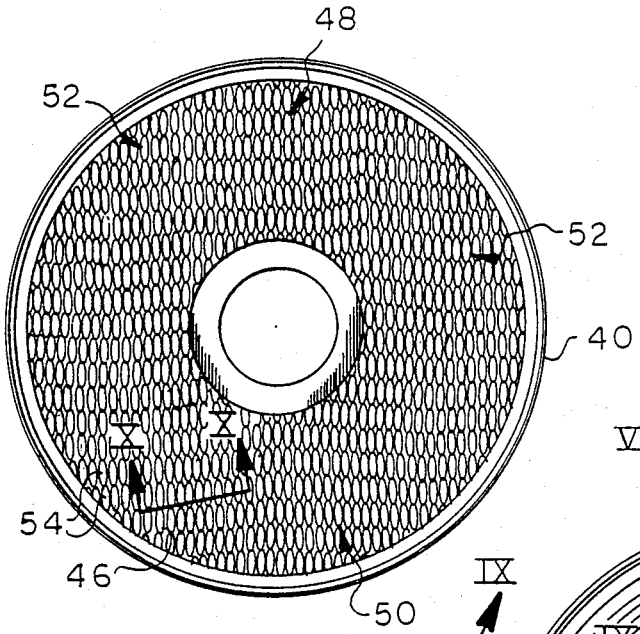
FIG. 5 is a front plan view of a reflector constructed in accord with the invention.

With reference to FIGS. 5-13, the configuration and surface of the inner light reflecting surface of the reflector will be described. For purpose of description the inner reflector surface 46 includes an upper region 48, a lower region 50 and lateral regions 52 intermediate the upper and lower regions. In the embodiment of FIG. 5, the entire inner reflecting surface of 46 the reflector is provided with a plurality of adjacent substantially parallel peenings 54 of approximately $\frac{3}{4}''$ height and $\frac{1}{8}''$ width and these peenings cover the upper, lower and lateral regions. The peenings are formed by utilizing a 5/16" diameter cylindrical tool to form an impression in the metal die or mandrel used to form the reflector by a spinning metal forming operation wherein by the use of a roller the reflector inner surface 46 is forced against the peened mandrel and the reflecting surfaces formed. The depressions in the mandrel will create a ridge in the reflector inner surface, and the portions intermediate the ridges comprise depressions of a concave configuration as will be appreciated from FIG. 10.

The peened ridges and recesses in the reflector inner surface 46 are substantially vertically oriented wherein the major dimensional axis of the ridges and recesses extends in the vertical direction, while the minor dimension is substantially in the horizontal direction.

Figure 4:
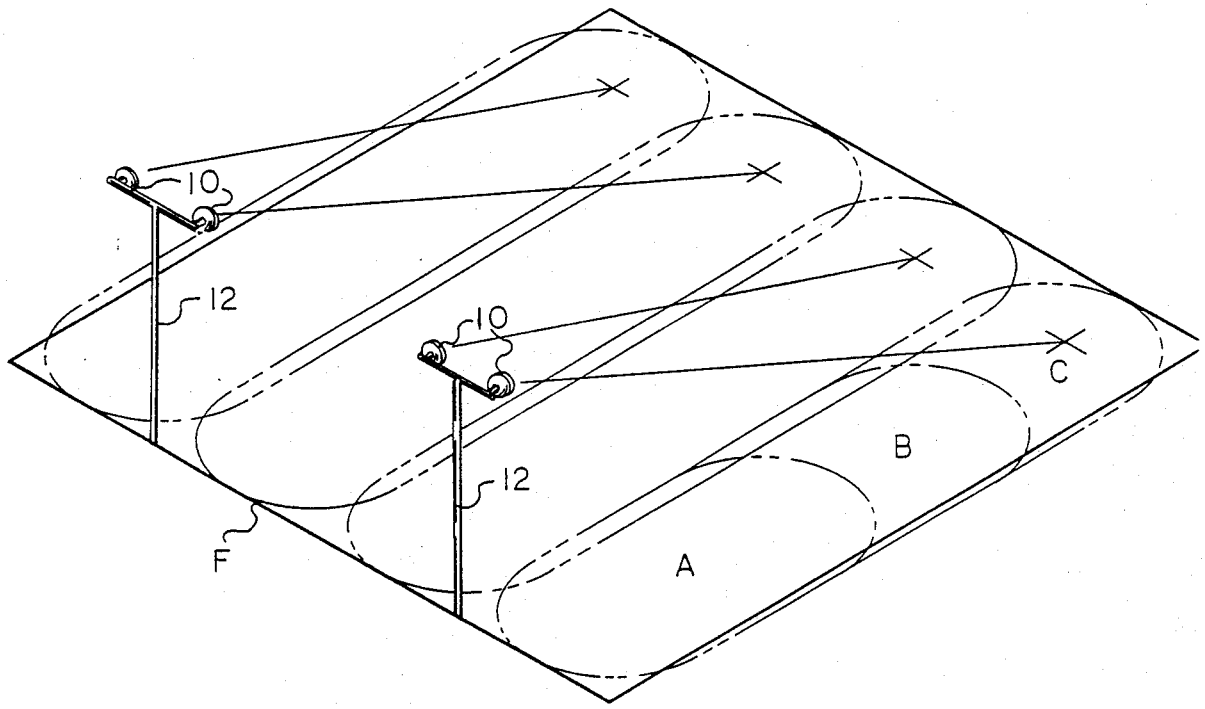
FIG. 4 is a perspective schematic view illustrating the distribution of light over a playing area utilizing the reflectors of the invention.
Figure 7:
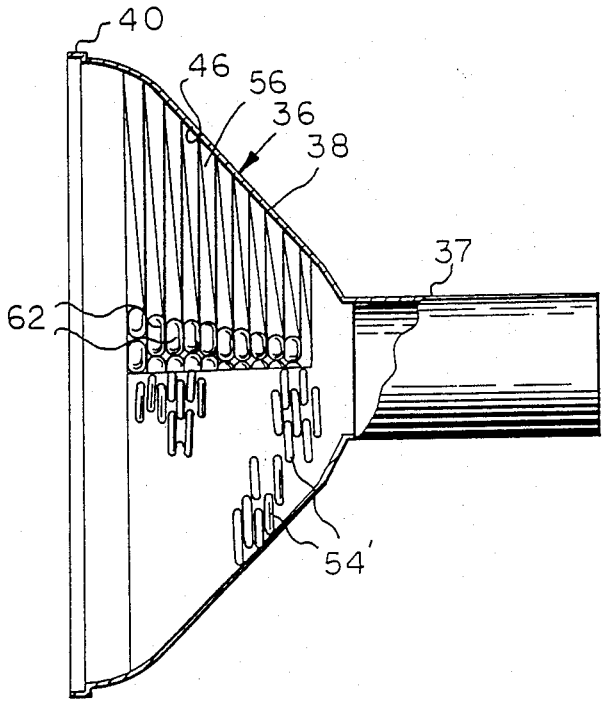
FIG. 7 is an elevational, partial sectional view of a reflector in accord with the invention as taken along Section VII—VII of FIG. 6.

The effect of the peenings having a major axis vertically oriented is to produce a projected light beam of an elliptical configuration, and such an elliptical oval configuration will be appreciated from the schematic illustration of FIG. 4 disclosing the dissemination of light from four luminaires 10 over a substantially rectangular area to be illuminated, such as a football field F. The configuration and orientation of the peenings provides a high efficiency elliptical or oblong shaping of the light beam and a reflector of this type minimizes light spillage and light pollution into areas adjacent the area intended to be illuminated.

Figure 6:
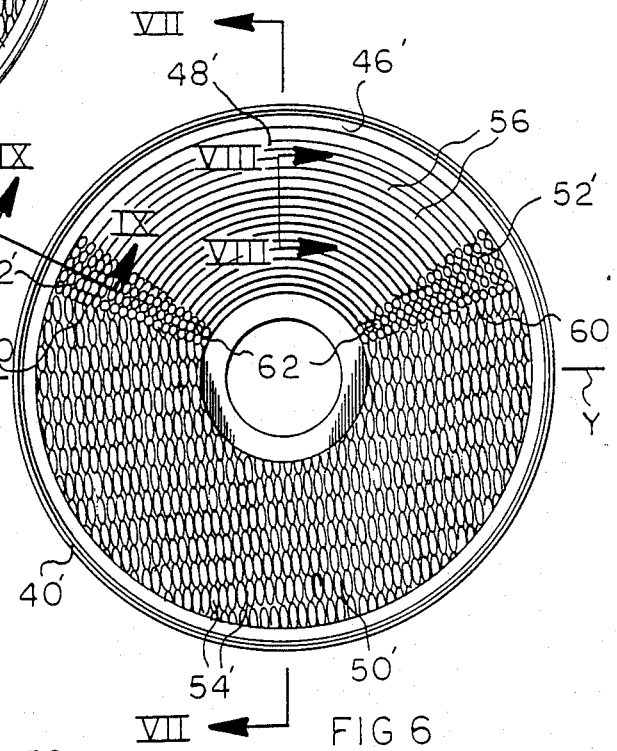
FIG. 6 is a front plan view of another embodiment of a reflector constructed in accord with the invention utilizing three types of reflecting surfaces.
Figure 8:
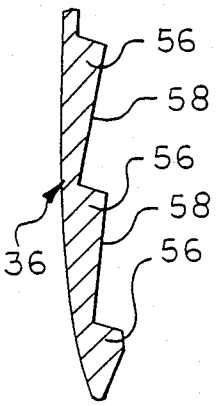
FIG. 8 is an enlarged, sectional view taken along Section VIII—VIII of FIG. 6.
Figure 9:
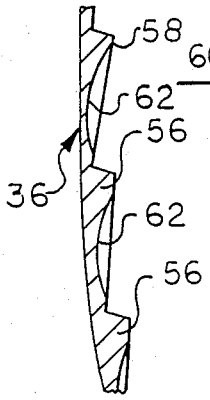
FIG. 9 is an enlarged, elevational, sectional view taken along Section IX—IX of FIG. 6.
Figure 11:
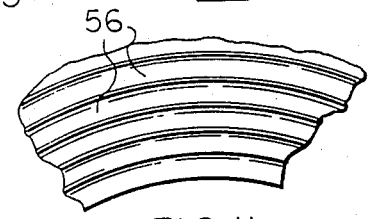
FIG. 11 is an enlarged, detail plan view as taken from the right of FIG. 8.
Figure 12:
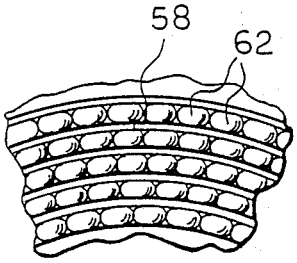
FIG. 12 is an enlarged, detail, plan view as taken from the right of FIG. 9.
Figure 13:
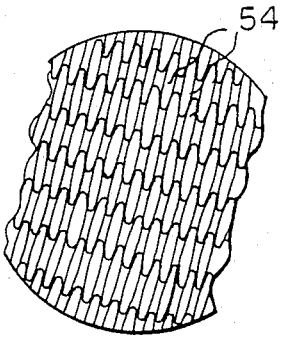
FIG. 13 is an enlarged, detail, plan view of the peened surface used in the embodiment of FIG. 5 and in the lower region of the embodiment of FIG. 6, as taken from the top of FIG. 10.
Figure 10:
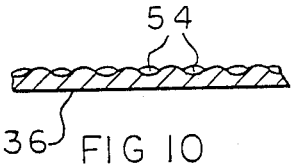
FIG. 10 is an enlarged, detail, sectional view as taken along Section X—X of FIG. 5.

FIG. 6 illustrates a variation in the configuration of the reflector reflecting surface as designated 46'. As apparent in FIG. 6, the lower region 50' of the reflecting surface is provided with peenings 54' identical to those described above with respect to the embodiment of FIG. 5, and the peenings are vertically oriented wherein the major axis extends in a vertical direction with respect to the upper and lower regions of the reflector surface. However, in the lateral regions 52' and upper region 48' of the reflecting surface 46' a plurality of concentric flutes 56 are defined in the surface forming conical reflecting surfaces 58 and the surfaces 58 are stepped and concentric to the reflector axis as will be appreciated from FIGS. 6 and 8. The flutes 56 extend between the reflector inner surface definition lines 60 constituting 140° of the lateral and upper regions 52' and 48'. The terminating edges of the flutes 56 are located at 20° above the reflector Y axis as viewed in FIG. 7.

Throughout 20° of the flutes 56 above the flute definition lines 60 the flutes are formed with a plurality of elliptical recesses or depressions 62 having a major axis substantially concentrically related to the reflector axis and substantially conforming to the configuration of the associated flute. The major dimension of the depressions 62 in the circumferential direction is substantially twice that of the depression minor dimension, which is radially disposed, FIG. 12.

The flute surfaces 58 located at the reflector upper region 48' and intermediate the lateral regions 52' upon which the depressions 62 are formed, i.e. the upper 100° of the flutes 56, are free of depressions and the light reflected from the flute surfaces 58 will be reflected without diffusion or distortion.

Light being reflected from a reflector surface 46' shown in FIGS. 6–13 causes the light reflected from the peenings 54' located at the lower region to be formed in an oval pattern and the light will be substantially uniformly dispersed over the lighted area at the region closest to the luminaire as represented at area A in FIG. 4. Light reflected by the depressions 62 will not be diffused and dispersed to the extent as the light reflected by peenings 54', and such light will be reflected toward the area B as shown in FIG. 4

The light reflected from flute surfaces 58 is substantially undiffused and will be projected to the furthest regions of the reflected light beam, i.e. area C, FIG. 4, and it will therefore be appreciated that the light reflector 36' constructed in accord with the arrangement of FIGS. 6–13 will diffuse the light in a manner to most efficiently produce a relatively uniform distribution over the lighted area even though the light beam is obliquely related to the surface being illuminated.

The use of the peenings is governed by three factors. The first is the curvature of the basic parabolic reflector surface which changes radially as well as circumferentially out from the origin of the reflector. The peen mark spreads the light by causing a controlled deviation of the light beam at each mark equivalent to how the light bends from each peen's change in curvature The second factor is therefore the curvature of the peen mark. The angular change in the light beam varies by the differences in the curvature of the peen versus the curvature of the reflector. Peens therefore produce results that are the difference of two curves whose slope angle are both positive or negative versus two curves of opposite slope where one is positive and the other is negative The third variable is the depth of the peen mark since for a given radius of curvature the greater the depth of the mark the greater the angular change. As a reflector is formed the metal flows into the valleys on the tool surface but there is a limit to how much metal flow can be obtained with each method of reflector forming. Typical reflector metal forming includes spinning, hydraform, coining and stamping. A practical limit of metal flow into valleys or tool surface depressions such as peen marks is 0.030 to 0.050 inches depending upon the size of the reflector and location on the surface.

It is to be understood that the terms upper, lower and lateral are not to be limiting as the reflector 36 may be oriented so that the major dimension of the peenings 54 is horizontal or obliquely related to the horizontal so as to change the orientation of the oval lighted pattern with respect to the pole.

It is appreciated that various modifications to the inventive concepts may be apparent to those skilled in the art without departing from the spirit and scope of the invention.

What is claimed is:

1. A reflector for a light fixture comprising, in combination, a substantially parabolic reflecting shell having an inner concave light reflecting surface having a longitudinal axis adapted to be obliquely disposed to a horizontal plane during use and a plurality of adjacent elongated ridges and recesses defined in said shell inner surface having their length generally vertically oriented with respect to the horizontal plane and transverse to said axis producing adjacent elongated concave and convex light reflecting surfaces which project light in a generally vertically confined beam and wherein said recesses are defined by a plurality of end-to-end elliptical shaped depressions.

2. In a reflector as in claim 1 wherein said ridges and recesses are of a generally elongated narrow elliptical configuration.

3. In a reflector as in claim 2 wherein said ridges and recesses are defined by peening and are approximately $\frac{1}{8}''$ each in width and approximately $\frac{3}{4}''$ in length.

4. In a reflector as in claim 3, wherein said ridges and recesses are defined by peening using the side of a 5/16" diameter cylindrical tool.

5. A reflector for a light fixture characterized by its ability to evenly illuminate an area comprising, in combination, a substantially parabolic reflecting shell having an inner concave light-reflecting surface having a longitudinal axis adapted to be obliquely disposed to a horizontal plane during use, said shell in its operational orientation including an upper region, lateral regions and a lower region, and a plurality of adjacent elongated ridges and recesses defined in said lower region having their length generally vertically oriented with respect to the horizontal plane and transverse to said axis producing adjacent elongated concave and convex light reflecting surfaces which project light in a generally vertically confined beam and wherein said recesses are defined by a plurality of end-to-end elliptical shaped depressions.

6. In a reflector as in claim 5 wherein said ridges and recesses are of a generally elongated narrow elliptical configuration.

7. In a reflector as in claim 5 wherein said ridges and recesses are defined by peening and are approximately $\frac{1}{8}''$ each in width and approximately $\frac{3}{4}''$ in length.

8. In a reflector as in claim 5, a plurality of adjacent concave depressions defined in said shell lateral regions, said depressions being of a generally elliptical configuration having a length defined by ends.

9. In a reflector as in claim 8, said depressions being arranged in rows concentric to said shell axis and adjacent depressions being in a substantially contiguous end-to-end relationship.

10. In a reflector as in claim 5, a plurality of conical concentric light reflecting surfaces defined on said shell upper region of a configuration to reflect light with a minimum of diffusion.

11. In a reflector as in claim 10, said conical concentric light reflecting surfaces each being of a conical segment configuration.

* * * * *